US008602751B2

(12) United States Patent
Courier

(10) Patent No.: US 8,602,751 B2
(45) Date of Patent: Dec. 10, 2013

(54) TRANSFER PUMP

(75) Inventor: John P. Courier, Renton, WA (US)

(73) Assignee: International Pump Manufacturing Inc., Sumner, WA (US)

( * ) Notice: Subject to any disclaimer, the term of this patent is extended or adjusted under 35 U.S.C. 154(b) by 403 days.

(21) Appl. No.: 13/019,862

(22) Filed: Feb. 2, 2011

(65) Prior Publication Data

US 2011/0189034 A1 Aug. 4, 2011

Related U.S. Application Data

(60) Provisional application No. 61/300,769, filed on Feb. 2, 2010.

(51) Int. Cl.
*F04B 53/10* (2006.01)
*F04B 53/16* (2006.01)
*F04B 17/00* (2006.01)

(52) U.S. Cl.
USPC ..... 417/399; 417/555.1; 417/423.15; 417/545

(58) Field of Classification Search
USPC ..... 417/555.1, 259, 399, 403, 404, 401, 417/423.15, 444, 448, 483, 495, 523, 529, 417/534, 537, 545; 91/40, 55, 152
See application file for complete search history.

(56) References Cited

U.S. PATENT DOCUMENTS 1,964,245 A 6/1934 Benadek
2,006,880 A 7/1935 Benedek
2,255,851 A 9/1941 Lundin
2,255,852 A 9/1941 Lundin
2,387,234 A * 10/1945 Clapp ..... 91/40
2,540,939 A * 2/1951 Foster ..... 91/337
2,568,357 A 9/1951 Moulden
2,765,804 A * 10/1956 Dinkelkamp ..... 137/102
3,827,339 A * 8/1974 Rosen et al. ..... 92/152

(Continued)

FOREIGN PATENT DOCUMENTS

GB 1 382 741 2/1975

OTHER PUBLICATIONS

"High Performance Coatings & Foam Equipment: For All Your Spray Foam and Polyurea Applications," Graco, Inc., Minneapolis, Minn., Form No. 337488B, Oct. 2006, 2-page brochure.
"IP-01, 1:1 Ratio Transfer Pump: Operating Manual," International Pump Manufacturing, Inc. (IPM), Sumner, Wash., Manual No. MIP11192008, Nov. 2008, 33 pages.
"OP232-INST, 2:1 Ratio Transfer Pump: Operating Manual," International Pump Manufacturing, Inc. (IPM), Sumner, Wash., Manual No. 500297, Feb. 2009, 33 pages.

(Continued)

*Primary Examiner* — Devon Kramer
*Assistant Examiner* — Nathan Zollinger
(74) *Attorney, Agent, or Firm* — Christensen O'Connor Johnson Kindness PLLC

(57) ABSTRACT

A transfer pump includes a motor that attaches to a manifold with a motor mount that seals a top end of the manifold. The motor mount includes a tubular portion that extends into and threadably engages the manifold, to cooperatively define a channel therethrough. The manifold includes a plurality of inlet ports arranged generally in an annular pattern. An inner cylinder attaches to the manifold from below, disposed radially inward from the inlet ports, and a pressure cylinder attaches to the manifold, disposed radially outward from the inlet ports. The pressure cylinder includes a foot valve. A pump shaft extends from the motor, through the channel, and into the pressure cylinder. A large piston with a check valve is attached to the distal end of the shaft, and a small piston disposed in the inner cylinder is attached at an intermediate location.

14 Claims, 9 Drawing Sheets

(56) References Cited

U.S. PATENT DOCUMENTS

| | | | | |
|---|---|---|---|---|
| 3,927,605 | A | 12/1975 | Siczek | |
| 4,199,303 | A | 4/1980 | Gusmer | |
| 4,312,463 | A | 1/1982 | Daby | |
| 4,313,714 | A | 2/1982 | Kubeczka | |
| 4,444,547 | A * | 4/1984 | Stolz | 417/46 |
| 4,681,516 | A * | 7/1987 | O'Hara et al. | 417/259 |
| 4,874,297 | A | 10/1989 | Collins | |
| 5,167,493 | A | 12/1992 | Kobari | |
| 5,388,761 | A | 2/1995 | Langeman | |
| 5,524,797 | A | 6/1996 | Schultz, Sr. | |
| 5,642,988 | A | 7/1997 | Zorn | |
| 6,168,308 | B1 | 1/2001 | Pittman | |
| 6,283,329 | B1 | 9/2001 | Bezaire | |
| 6,641,375 | B2 * | 11/2003 | Liao | 417/360 |
| 2008/0240944 | A1 * | 10/2008 | Arens | 417/399 |
| 2009/0074591 | A1 | 3/2009 | Courier | |

OTHER PUBLICATIONS

"Reactor® : A-20 Plural-Component Proportioner," Graco, Inc., Minneapolis, Minn., Form No. 338319, Rev. A., Sep. 2006, 2-page brochure.

"Reactor® & Fusion® : High-Performance Proportioning Systems Designed to Apply Polyurea, Foam and Other Fast-Set Materials," Graco, Inc., Minneapolis, Minn., Form No. 300615, Rev. C., Jan. 2005, 20-page catalog.

"Reactor® : H-25™ and H-XP2™ Hydraulic-Driven Proportioners," Graco, Inc., Minneapolis, Minn., 2005, 2-page brochure.

"Reactor® H-40 and H-XP3 High-Output Hydraulic Proportioners," Graco, Inc., Minneapolis, Minn., Jan. 2007, 2-page brochure.

"Reactor™ : High-Performance Proportioning System Designed to Apply Polyurea, Foam and Other Fast-Set Materials," Graco, Inc., Minneapolis, Minn., Form No. 300628, Rev. B, Jun. 2003, 12-page catalog.

* cited by examiner

TRANSFER PUMP

CROSS-REFERENCE TO RELATED APPLICATION

This application claims the benefit of Provisional Application No. 61/300,769, filed Feb. 2, 2010, the entire disclosure of which is hereby incorporated by reference herein.

BACKGROUND

A conventional transfer pump 100 for pumping a viscous material to relatively high pressures is shown in FIG. 1. An example of a pump generally of the type shown in FIG. 1 is the OP232 Series Polyurethane pump marketed by International Pump Manufacturing Inc. The pump 100 has a motor 102, for example, an air motor with an air inlet valve 101. The motor 102 is configured to drive a pump drive shaft 103 in a reciprocating motion. A plurality of standoffs 104 attach the motor 102 to a pump body 106. The pump body 106 includes three small-diameter tubes 110 that are fluidly connected at an upper end with a pump outlet manifold 108, and are fluidly connected at the opposite end to a suction or pressure cylinder 112. The bottom end of the pressure cylinder 112 has a ball-type foot valve 114. During use the foot valve 114 end of the pump 100 is typically inserted directly into a large container or reservoir of material to be pumped. The material is then drawn through the foot valve 114 and pressurized as discussed below.

FIG. 2 is a schematic illustration of the pump 100, illustrating the operation of the pump 100. The pump 100 is a double-acting pump, i.e., a pumping or pressurizing action is achieved on both the down-stroke and the up-stroke of the pump shaft 103. The motor indicated by the arrow 102 drives the pump shaft 103 in reciprocating motion. The pump shaft 103 extends downwardly through a center channel in the outlet manifold 108, between the small tubes 110 and into the pressure cylinder 112. The base 116 of the pump body 106 is attached to the pressure cylinder 112, such that the small tubes 110 are fluidly connected to the pressure cylinder 112.

An inner cylinder 118 extends downwardly from the base 116 coaxially within the pressure cylinder 112. Therefore an annular flow region 117 is formed between the inner cylinder 118 and the pressure cylinder 112. A smaller cylindrical volume is defined by the interior of the inner cylinder 118. A large piston 120 is attached to the distal end of the pump shaft 103 and slidably engages the pressure cylinder 112. The large piston 120 includes an inner check valve 122 that closes from fluid pressure when the large piston 120 is moving up, and opens when the large piston 120 is moving down. The foot valve 114 opens when the large piston 120 is moving up, and closes when the large piston 120 is moving down. A small piston 124 is attached at an intermediate location to the pump shaft 103, and slidably reciprocates within the inner cylinder 118.

The operation of the pump 100 can now be understood. During the up-stroke, the inner check valve 122 closes, and the foot valve 114 opens, such that material is drawn into the pressure cylinder 112 from the reservoir 90 (arrow 91). The material above the large piston 120 is pressurized by the upwardly moving large piston 120. A portion of the fluid in the pressure cylinder 112 enters the inner cylinder 118 (arrows 93), and a portion flows through the annular region 117 and into the small tubes 110 (arrows 94).

During the down-stroke of the pump shaft 103, the foot valve 114 closes and the inner check valve 122 opens such that the material below the large piston 120 flows through the inner check valve 122 (arrow 92). The small piston 124 also moves downwardly, forcing material from the inner cylinder 118 (arrows 93) into the region below, again pressurizing the pressure cylinder 112. Material is therefore flows through the annular region 117 and into the small tubes 110. The pressurized material forced into the small tubes 110 is thereby ejected from the outlet manifold 108 (arrow 95), typically to a spray gun or other dispersal tool (not shown).

The transfer pump 100 of the type disclosed has performed well in the art for suitable applications. However, there are some disadvantages to the pump 100. For example, forcing very viscous material through multiple small tubes 110 requires a lot of work, and the small tubes may be difficult to clean and are prone to clogging. Also, during shipping, maintenance, or the like, the small tubes 110 may become bent or otherwise damaged. Also, due to leakage through the base 116 of the pump body at the pump shaft 103 seal, in the past it has not been practical to mount the pump 100 away from the material reservoir (e.g., with a wall mount), using a flexible conduit to fluidly connect the foot check valve 114 with the material.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A transfer pump is disclosed having a motor, for example an air motor, that is attached to a motor mount with a plurality of standoffs. The motor mount includes a tubular portion defining a channel. An outlet manifold having an outlet port and a plurality of inlet ports, for example 5-7 inlet ports, is attached to the motor mount such that the channel extends through the manifold. An inner cylinder attaches to and extends downwardly from the outlet manifold such that all of the inlet ports are disposed above and radially outwardly from the inner cylinder, and a larger pressure cylinder extends downwardly and attaches to the outlet manifold such that all of the inlet ports are disposed above and radially inwardly from the pressure cylinder. A foot valve is attached near the distal end of the pressure cylinder. The inner cylinder and pressure cylinder therefore define an annular flow path that fluidly connects the manifold chamber through the plurality of inlet ports. A pump shaft assembly is driven in reciprocating motion by the motor and extends through the outlet manifold, the inner cylinder and the pressure cylinder. A small piston is disposed in the inner cylinder and fixed to the drive shaft and a large piston is attached near a distal end of the shaft, the large piston having a check valve.

In an embodiment the outlet manifold further comprises a pressure relief port open to the atmosphere that provides a flow path to the inner cylinder.

In an embodiment the small piston further comprises a lip seal that slidably engages the inner cylinder.

In an embodiment the transfer pump is a double-acting pump.

In an embodiment the tubular portion of the motor mount has a distal end having a circumferential recess, and further comprising an O-ring that is configured to sit in the circumferential recess to sealingly engage the outlet manifold and a gasket that engages the distal end of the tubular portion to sealingly engage the outlet manifold.

In an embodiment the transfer pump includes a wall mounting bracket.

In an embodiment the transfer pump is a double-acting polyurethane transfer pump.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIGS. 3A and 3B show a transfer pump in accordance with the present invention, wherein FIG. 3A is a perspective view, and FIG. 3B shows the pressure cylinder and the inner cylinder in phantom;

DETAILED DESCRIPTION

Figure 3A:
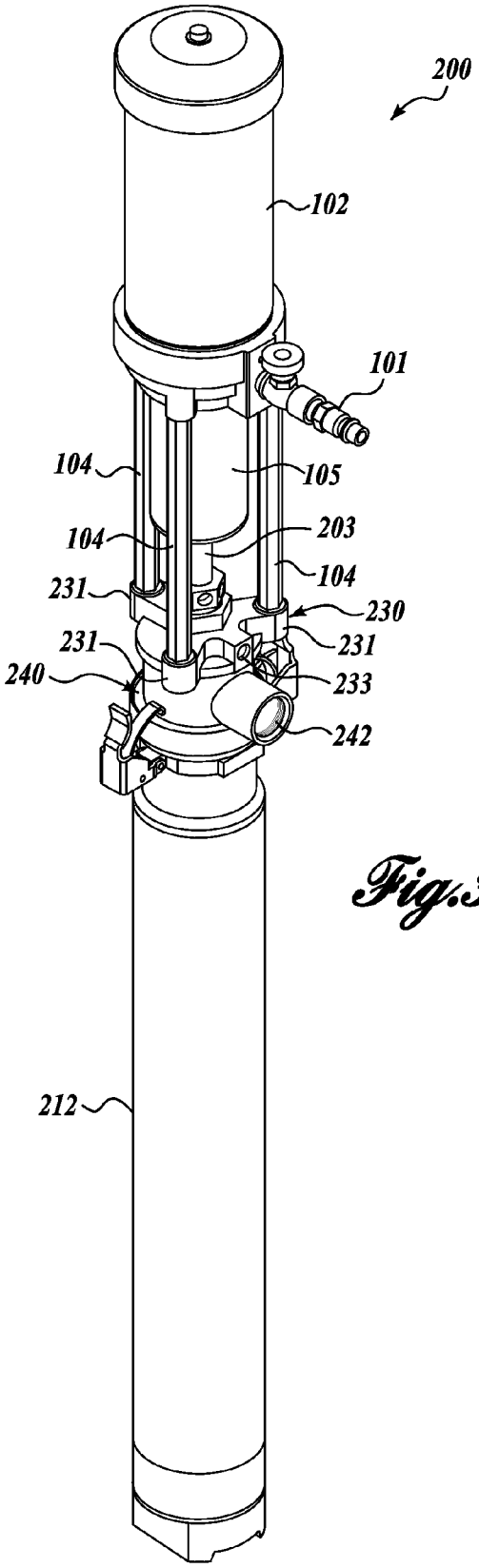

FIG. 3A shows a transfer pump 200 in accordance with the present invention. The pump 200 may be used in many applications and is particularly suited to use in the polyurethane foam, spray-foam, and polyurea coatings industries. For example, the pump 200 may be used for pumping polyols resins and isocyanate from drums or totes to proportioners for two-component spraying or pouring of foam or coatings.

Figure 1:
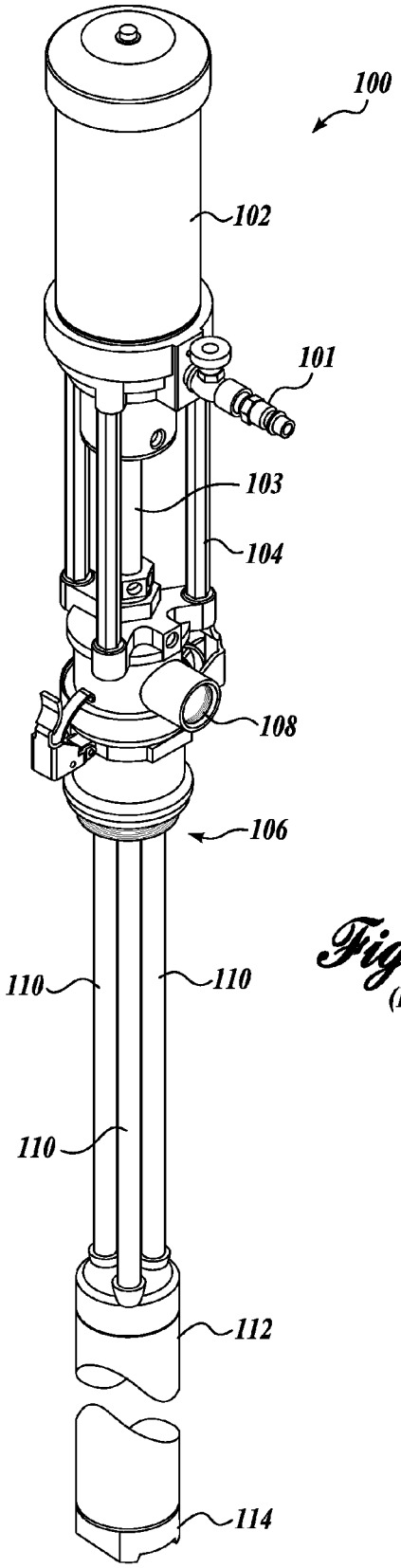
Fig.1. (PRIOR ART)
FIG. 1 shows a prior art transfer pump.

Advantages of the pump 200 over prior art pumps such as that shown in FIG. 1, include:

- Elimination of the long, small-diameter transfer tubes.
- Elimination of fifteen stainless steel welds reducing risk of misaligned parts.
- Increased flow rate capability.
- Reduced risk of leakage in and around the outlet manifold, with addition of O-ring seal in combination with gasket.
- Fewer and more simply constructed components.
- Relatively easy disassembly for cleaning.
- The pump may be wall mountable with a foot valve siphon tube.

The transfer pump 200 includes a motor 102, for example, a reciprocating air motor. An air inlet valve 101 is configured to attach a compressed air source (not shown) to drive the motor 102. The motor 102 is attached to the pump body through a plurality of standoffs 104 (three shown) that extend upwardly from a motor mount 230. The standoffs 104 provide space to permit reciprocation of the air motor piston 105. The motor mount 230 is attached directly to an outlet manifold 240 having an outflow port 242, as discussed in more detail below. Unlike the prior art pump 100, the outlet manifold 240 in the present pump 200 attaches directly to the pump pressure cylinder 212, and receives pressurized material directly from the pressure cylinder 212.

The motor mount 230 includes radially disposed arms 231 that have apertures for attachment to the standoffs 104, and a center aperture that is threaded at the top to receive the packing and seal components (not shown, e.g., seal retainer, FE packing, seal expander) as are well known in the art. A side aperture 233 for a grounding lug is also provided.

Figure 2:
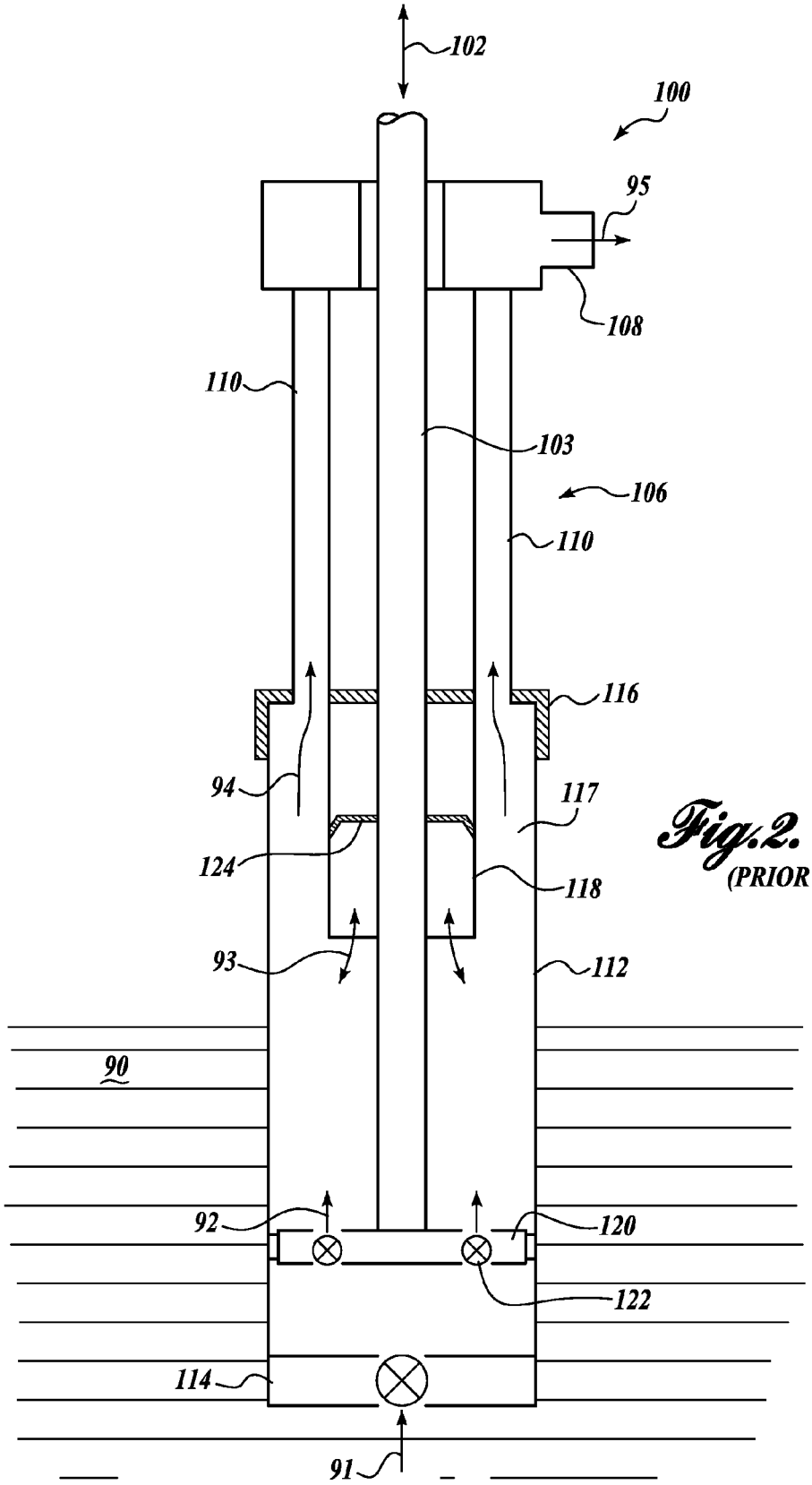
Fig.2. (PRIOR ART)
FIG. 2 shows schematically a cross-sectional view of a lower portion of the prior art transfer pump shown in FIG. 1.
Figure 3B:
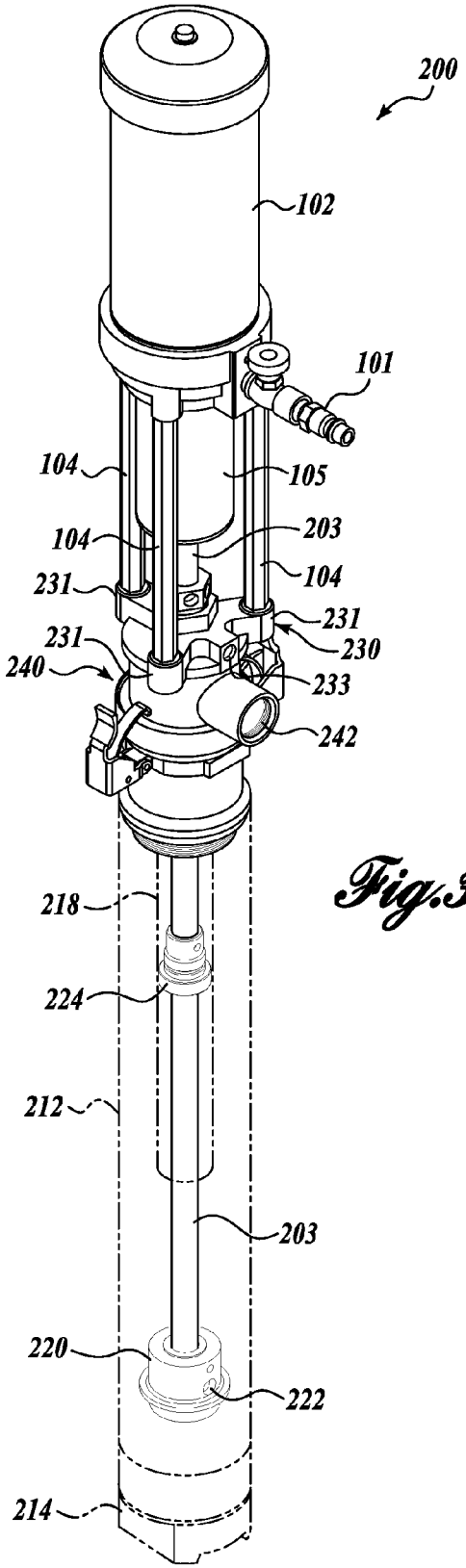
Figure 4:
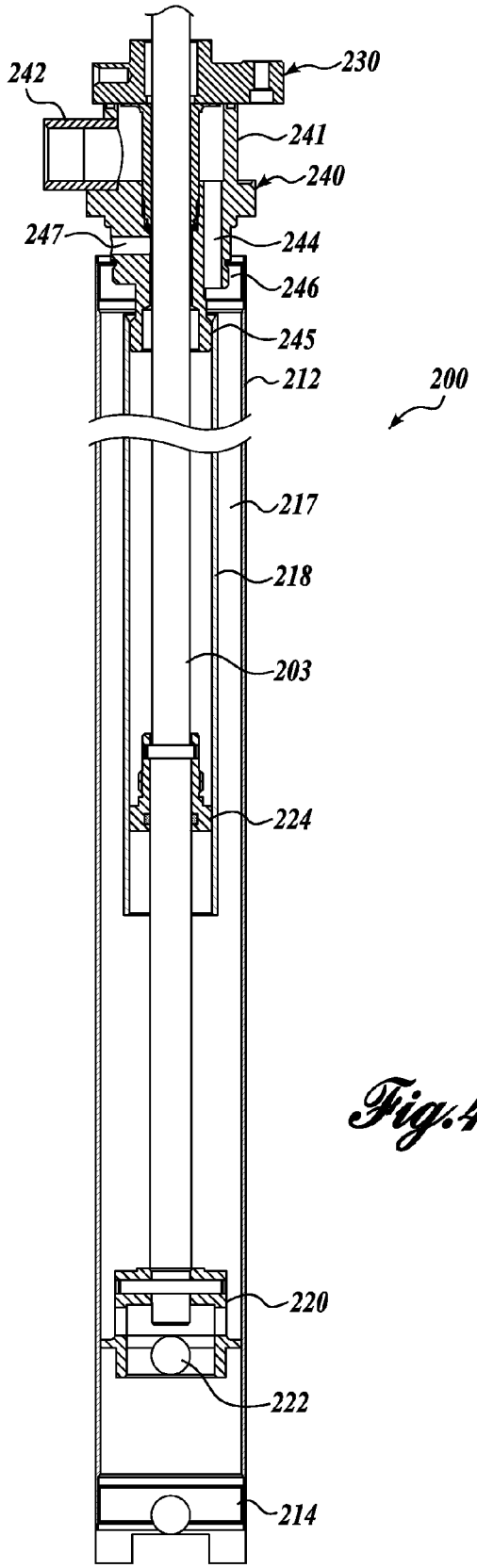
FIG. 4 shows a side, cross-sectional view of the lower portion of the transfer pump shown in FIG. 3A.

Refer now also to FIG. 3B, which shows the transfer pump 200 with portions of the transfer pump 200 shown in phantom to reveal internal components, and also to FIG. 4, which shows a cross-sectional side view of the body of the pump 200. It will be appreciated by comparison of FIG. 3B with FIG. 2 and the corresponding description above, that the transfer pump 200 operates in a similar manner as a double-acting pump.

A foot valve 214 is attached to the distal end of the pressure cylinder 212, and a large piston 220 is fixed to the distal end of the pump shaft 203. The large piston 220 includes an inner check valve 222 that is oriented to open on the down-stroke and close on the up-stroke. An inner cylinder 218 is concentrically disposed in the pressure cylinder 212, extending from the distal end of the outlet manifold 240. A small piston 224, preferably including a lip seal, is attached to the pump shaft 203 and is slidably disposed within the inner cylinder 218.

When operating, during the up-stroke of the pump shaft 203 material from the reservoir is drawn into the pressure cylinder 212 through the foot valve 214, and material in the pressure cylinder 212 above the large piston 220 is thereby pressurized. A portion of the material enters the inner cylinder 218, below the small piston 224. During the down-stroke of the pump shaft 203, the foot valve 214 closes and the inner check valve 222 opens, such that material flows through the inner check valve 222. The small piston 224 pushes material out of the inner cylinder 218 thereby pressurizing the pressure cylinder 212. Therefore, in both the up-stroke and the down-stroke, material in the pressure cylinder 212 is pressurized and thereby flows through the annular flow path 217 and into the outlet manifold 240, as described below.

Unlike the prior art pump 100 shown in FIG. 1, the pressure cylinder 212 and the long inner cylinder 218 define an annular flow path 217 that extends from the bottom of the inner cylinder 218 to the inlet for the outlet manifold 240. Therefore, no intermediate small-diameter tubes are required.

Figure 5A:
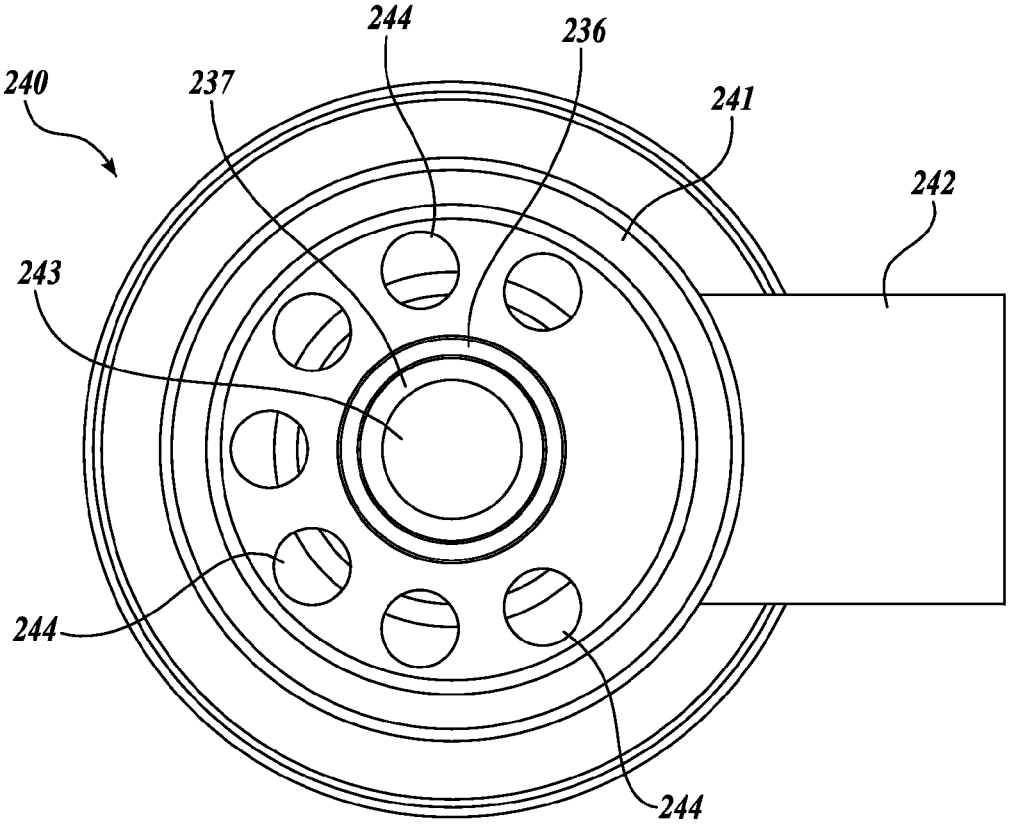
FIG. 5A is a plan view of the manifold for the transfer pump shown in FIG. 3A.
Figure 5B:
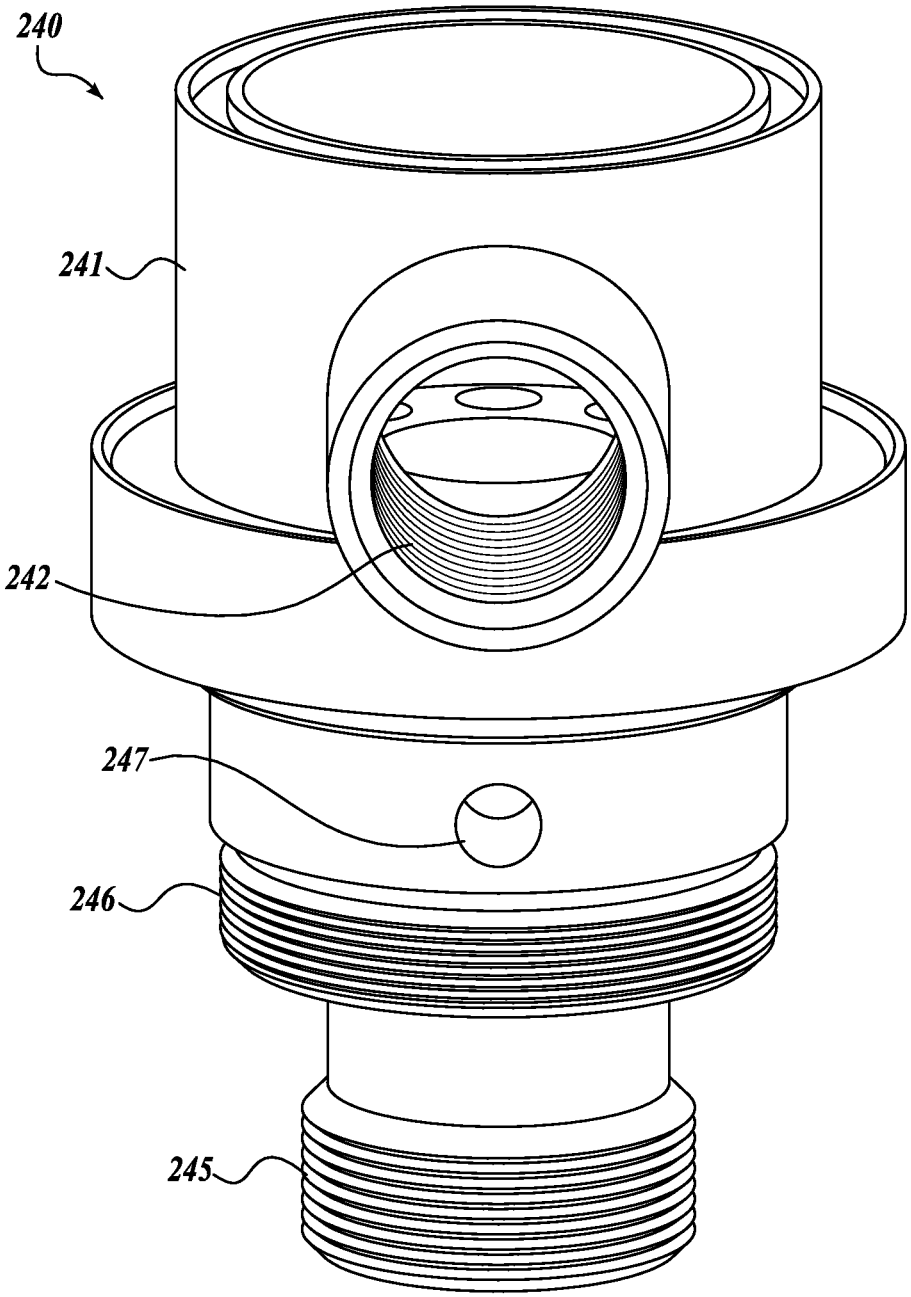
FIG. 5B is a front view of the manifold for the transfer pump shown in FIG. 3A.

A plan view of the outlet manifold 240 is shown in isolation in FIG. 5A, and a front view is shown in FIG. 5B. The outlet manifold 240 defines a large bowl-like manifold portion 241 having an outflow port 242. A center aperture 243 is threaded and adapted to sealingly receive a threaded tubular portion 234 (see FIG. 6) of the motor mount 230.

A plurality of through-flow apertures 244 (seven shown) provide entry for the pumped material from the pressure cylinder annular flow path 217 into the outlet manifold portion 241 (see FIG. 4). The relatively large number of apertures 244 for flow into the outlet manifold portion 241 provides greater flow area for material than the prior art pump 100 shown in FIG. 1.

As seen most clearly in FIG. 5B and with reference to FIG. 4, the outlet manifold 240 has a threaded distal end 245 that is configured to threadably engage the inner cylinder 218. A threaded intermediate portion 246 of the outlet manifold 240 is configured to threadably engage the pressure cylinder 212. It will be apparent that the distal end, or inlet end, of the through-flow apertures 244 are located radially inwardly from the threaded intermediate portion 246.

Figure 6:
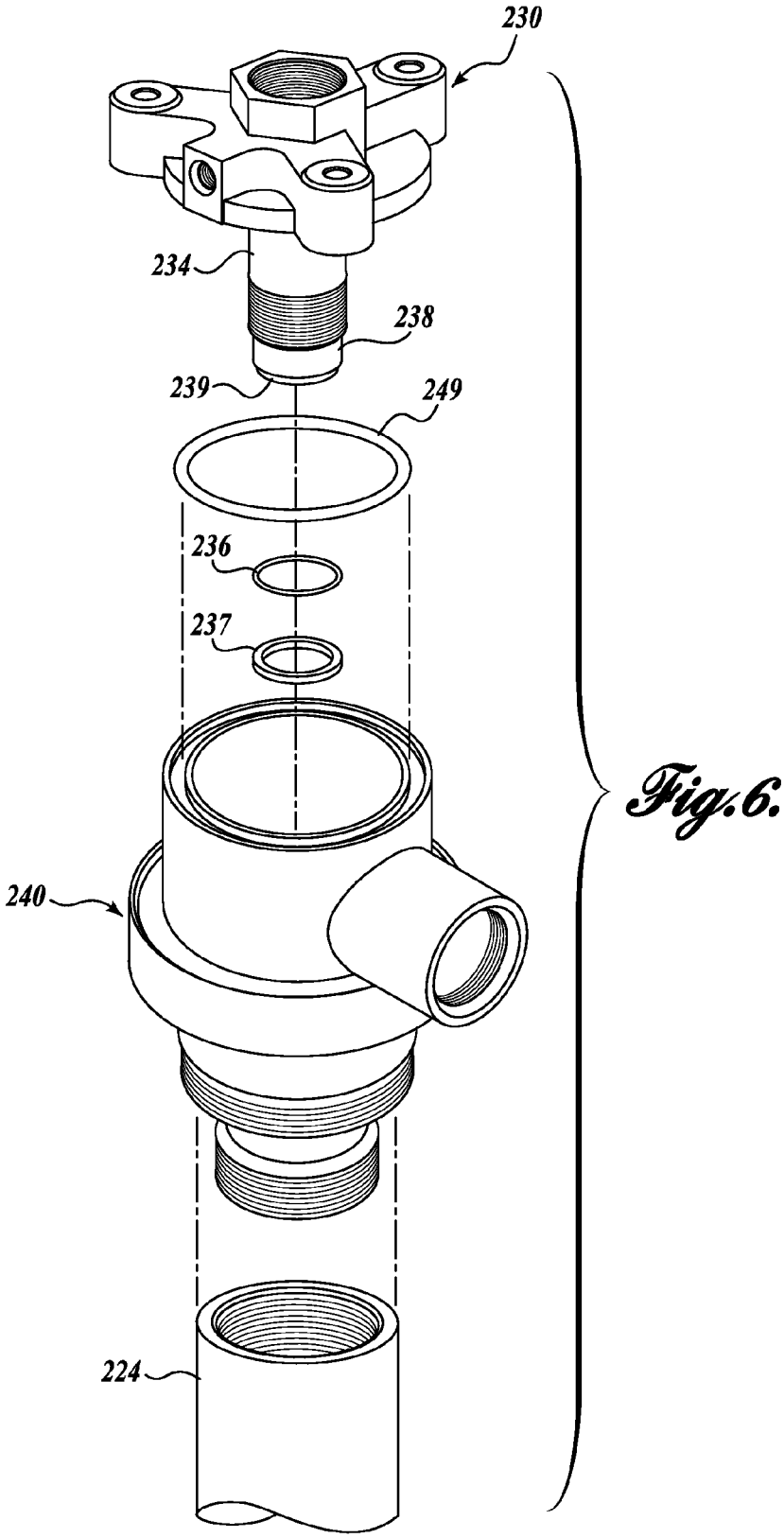
FIG. 6 is an exploded view of a portion of the pump body for the transfer pump shown in FIG. 3A.

An exploded view of portions of the pump 200 is shown in FIG. 6, which illustrates the attachment of the motor mount 230 to the outlet manifold 240. The motor mount 230 in this embodiment includes a tubular portion 234 that extends into the outlet manifold 240 and threadably engages the center aperture 243 (FIG. 5A). The tubular portion 234 defines an axial channel through the outlet manifold 240 to accommodate the reciprocating pump shaft 203.

A particular difficulty in certain prior art transfer pumps has been a tendency of material to leak from one or more joints in the pump shaft channel. In the current pump 200, a smaller-diameter distal end 238 of the tubular portion 234 of the motor mount 230 includes a circumferential recess 239 that is configured to receive an O-ring 236. In addition, a gasket or flat seal 237 abuts against the end of the tubular portion 234 and is compressed in the center aperture 232. It will now be appreciated that the smaller-diameter distal end 238 defines an annular ledge that abuts the flat seal 237. The combination of the O-ring 236 and gasket 237 produces a secure seal to prevent material leakage. In addition, a large O-ring 249 is provided such that the motor mount 230 sealingly engages the upper end of the outlet manifold 240.

Therefore, the motor mount 230 is attached to the outlet manifold 240 with the threaded section of the tubular portion 234. The tubular portion 234 has an axial aperture 232 that is sized to slidably receive the pump shaft 203, which extends through the outlet manifold 240 and into the pressure cylinder 212. A pressure relief port 247 is provided to prevent large pressure fluctuations in the inner cylinder 218 above the small piston 224 (see FIG. 4) during operation.

Figure 7:
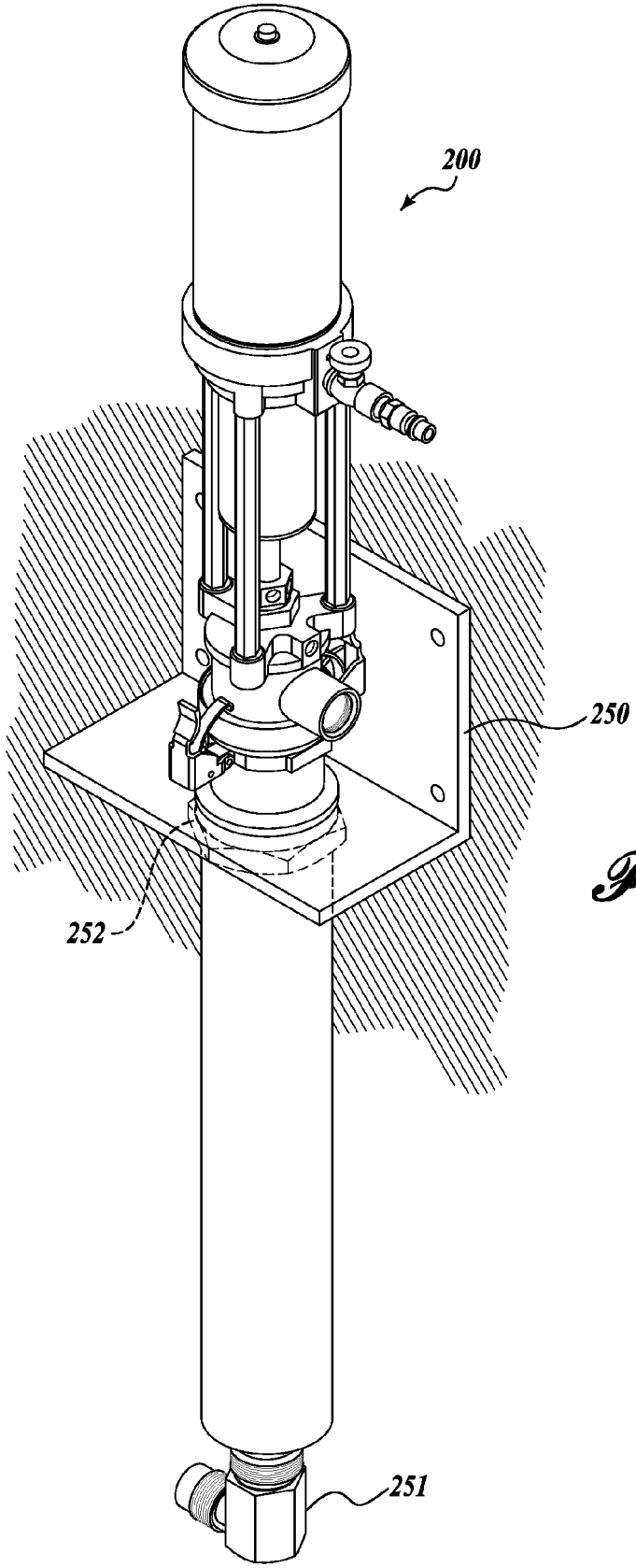
FIG. 7 shows the transfer pump of FIGS. 3A and 3B mounted using a wall mount bracket, and including a distal fitting for a foot valve siphon tube for connecting to a reservoir of material to be pumped.

In a particular embodiment shown in FIG. 7 the pump 200 is provided with a wall mount bracket 250 and attachment nut 252 such that the pump 200 can be mounted at a particular location. In this embodiment, a foot valve siphon tube fitting 251 is provided at the distal end of the pump 251 that is configured to be connected to a conduit that is inserted into the material reservoir.

A particular advantage of the pump 200 is the ease of assembly/disassembly for cleaning and servicing, and the ease of manufacture. For example, to disassemble the pump 200 a user may remove the motor 102, carefully disconnecting the pump shaft 203. The motor mount 230 may then be loosened or removed by unscrewing it from the outlet manifold 240. The pressure tube 212 may be removed by unscrewing it from the outlet manifold 240, and the foot valve 214 may be similarly removed from the pressure cylinder 212. The pump shaft 203 then may be removed for cleaning and/or service by pulling it from the distal end of the pump 200. The inner tube 218 may then be detached from the outlet manifold 240. The cleaning process is greatly facilitated by elimination of the small tubes 110 (FIG. 1).

While illustrative embodiments have been illustrated and described, it will be appreciated that various changes can be made therein without departing from the spirit and scope of the invention.

The embodiments of the invention in which an exclusive property or privilege is claimed are defined as follows:

1. A transfer pump comprising:

a motor;

a motor mount having a plurality of standoffs configured to engage the motor, and a tubular portion having an outer threaded portion and a center through channel;

an outlet manifold comprising a manifold chamber having an open upper end that is sized to be sealingly engaged by the motor mount and a center aperture that is threaded to releasably engage the outer threaded portion of the motor mount, wherein the manifold chamber defines a plurality of inlet ports and an outlet port;

an inner cylinder that sealingly attaches to the outlet manifold below the manifold chamber such that all of the inlet ports are disposed above and radially outwardly from the inner cylinder;

a pressure cylinder having a proximal end that sealingly attaches to the outlet manifold below the manifold chamber and a distal end having a foot valve, such that all of the inlet ports are disposed above and radially inwardly from the pressure cylinder, the inner cylinder and the pressure cylinder defining an annular flow path that is fluidly connected to the manifold chamber through the plurality of inlet ports;

a pump shaft assembly comprising an elongate shaft that is configured to be driven in reciprocating motion by the motor and extending through the outlet manifold, inner cylinder and pressure cylinder, the pump shaft assembly further comprising a small piston disposed in the inner cylinder and fixed to the elongate shaft and a large piston attached to a distal end of the elongate shaft, the large piston having a check valve, and wherein the small piston slidably engages the inner cylinder and the large piston slidably engages the pressure cylinder;

wherein the outlet manifold further comprises a radial pressure relief port open to the atmosphere that provides a flow path to the inner cylinder.

2. The transfer pump of claim 1, wherein the motor is an air motor.

3. The transfer pump of claim 1, wherein the small piston further comprises a lip seal that slidably engages the inner cylinder.

4. The transfer pump of claim 1, wherein the transfer pump is a double-acting pump.

5. The transfer pump of claim 1, wherein the tubular portion of the motor mount has a distal end having a circumferential recess, and further comprising an O-ring that is configured to sit in the circumferential recess to sealingly engage the outlet manifold and a gasket that engages the distal end of the tubular portion to sealingly engage the outlet manifold.

6. The transfer pump of claim 1, wherein the inner cylinder and the pressure cylinder are coaxially disposed.

7. The transfer pump of claim 1, further comprising a wall mounting bracket.

8. The transfer pump of claim 1, wherein the plurality of inlet ports comprise more than five inlet ports.

9. A double-acting polyurethane transfer pump comprising:

a reciprocating air motor attached to a motor mount having a tubular portion defining a central channel;

an outlet manifold having an open upper end that sealingly engages the motor mount, a manifold chamber having a center aperture that sealingly attaches to the tubular portion of the motor mount, a plurality of inlet ports arranged in an annular pattern, and an outlet port;

an inner cylinder having a proximal end that sealingly attaches to the outlet manifold below the manifold chamber;

a pressure cylinder having a proximal end that sealingly attaches to the outlet manifold below the manifold chamber such that the inner cylinder and pressure cylinder define an annular flow path that fluidly engages the plurality of inlet ports, wherein the pressure cylinder further comprises a foot valve;

a pump shaft assembly comprising an elongate shaft that is configured to be driven in reciprocating motion by the motor, the pump shaft assembly extending through the central channel and into the pressure cylinder, the pump shaft assembly further comprising a small piston disposed in the inner cylinder and a large piston disposed near a distal end of the pressure cylinder, the large piston having a check valve, and wherein the small piston slidably engages the inner cylinder and the large piston slidably engages the pressure cylinder;

wherein the outlet manifold further comprises a radial pressure relief port open to the atmosphere that provides a flow path to the inner cylinder.

10. The double-acting polyurethane transfer pump of claim 9, wherein the small piston further comprises a lip seal that slidably engages the inner cylinder.

11. The double-acting polyurethane transfer pump of claim 9, wherein the tubular portion of the motor mount has a distal end having a circumferential recess, and further comprising an O-ring that is configured to sit in the circumferential recess to sealingly engage the outlet manifold and a gasket that engages the distal end of the tubular portion to sealingly engage the outlet manifold.

12. The double-acting polyurethane transfer pump of claim 9, wherein the inner cylinder and the pressure cylinder are coaxially aligned.

13. The double-acting polyurethane transfer pump of claim 9, further comprising a wall mounting bracket.

14. The double-acting polyurethane transfer pump of claim 9, wherein the plurality of inlet ports comprise more than five inlet ports.

* * * * *